US007980431B1

(12) United States Patent
Barksdale

(10) Patent No.: US 7,980,431 B1
(45) **Date of Patent: *Jul. 19, 2011**

(54) EXTENDABLE POUR CAP

(75) Inventor: John Barksdale, Charlotte, NC (US)

(73) Assignee: Ipour, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/592,644

(22) Filed: Dec. 1, 2009

Related U.S. Application Data

(63) Continuation of application No. 11/454,096, filed on Jun. 15, 2006, now Pat. No. 7,624,899.

(60) Provisional application No. 60/694,306, filed on Jun. 27, 2005.

(51) Int. Cl.
*B67D 3/00* (2006.01)
*B65B 7/28* (2006.01)
*B65D 51/18* (2006.01)

(52) U.S. Cl. ..... 222/530; 222/527; 222/568; 215/43; 220/254.2; 220/254.8; 220/256.1

(58) Field of Classification Search ..... 222/499, 222/527, 528, 529, 530, 531, 532, 545, 546, 222/559, 562, 563, 566, 567, 568, 569, 109; 220/254.1, 254.2, 254.7, 254.8, 254.9, 254, 220/256.1, 259.3; 215/40, 43, 44
See application file for complete search history.

(56) References Cited

U.S. PATENT DOCUMENTS

| | | | | | |
|---|---|---|---|---|---|
| 2,895,654 | A | * | 7/1959 | Rieke | 222/529 |
| 3,128,016 | A | * | 4/1964 | Ferri, Jr. | 222/212 |
| 3,250,428 | A | * | 5/1966 | Rieke | 222/538 |
| 3,613,966 | A | * | 10/1971 | Summers | 222/529 |
| 4,095,728 | A | | 6/1978 | Chlystun | |
| 4,294,382 | A | * | 10/1981 | Summers et al. | 222/529 |
| 4,320,861 | A | * | 3/1982 | Rieke et al. | 222/541.9 |
| 4,426,027 | A | | 1/1984 | Maynard, Jr. | |
| 4,492,324 | A | | 1/1985 | Weber | |
| 4,555,048 | A | * | 11/1985 | Hamman et al. | 222/478 |
| 4,583,668 | A | * | 4/1986 | Maynard, Jr. | 222/529 |
| 4,600,125 | A | | 7/1986 | Maynard, Jr. | |
| 4,832,238 | A | | 5/1989 | Taylor | |
| 4,921,147 | A | | 5/1990 | Poirier | |
| D322,561 | S | | 12/1991 | Girouard | |
| 5,088,632 | A | * | 2/1992 | Odet et al. | 222/529 |
| 5,097,994 | A | | 3/1992 | Washam | |
| 5,133,481 | A | | 7/1992 | Mayfield | |
| 5,722,570 | A | | 3/1998 | Sultzer, III et al. | |
| 6,112,949 | A | * | 9/2000 | Rhodes et al. | 222/153.02 |
| D499,647 | S | | 12/2004 | Wills | |

OTHER PUBLICATIONS

Upon information and belief, applicant submits that the product shown in the attached photograph was in use or offered for sale prior to Jun. 15, 2006.

* cited by examiner

*Primary Examiner* — Kevin P Shaver
*Assistant Examiner* — Stephanie E Williams
(74) *Attorney, Agent, or Firm* — Schwartz Law Firm, P.C.

(57) ABSTRACT

An extendable pour cap includes a base adapted for attaching to a neck of a container. A flexible spout extends from the base, and is adapted for communicating with an open mouth of the container. The flexible spout has integrally-formed bellows designed for converting the spout between a compressed condition and an extended condition. A first closure element is designed for removably securing a first closure cap over the flexible spout when compressed. A second closure element is designed for removably securing a second closure cap over the flexible spout when compressed.

10 Claims, 5 Drawing Sheets

EXTENDABLE POUR CAP

TECHNICAL FIELD AND BACKGROUND OF THE INVENTION

This invention relates to an extendable pour cap. The invention is especially applicable for use with conventional plastic containers commonly used for holding vehicle fluids, such as motor oil, radiator fluid, windshield wiper fluid, and the like. The invention is likewise applicable for use on other plastic, metal, and/or glass containers, such as those used to store dry granular or powdery products. The invention allows convenient pouring of contents from the container to a desired destination in a generally controlled and focused manner, without spillage, and without the use of a funnel.

SUMMARY OF INVENTION

Therefore, it is an object of the invention to provide an extendable pour cap which reduces spills and substantially eliminates the need to use a funnel.

It is another object of the invention to provide an extendable pour cap which is designed for use on any standard plastic, metal, or glass container as a retro-fit item.

It is another object of the invention to provide an extendable pour cap which incorporates a flexible spout capable of extending several inches from a compressed condition to an extended condition.

It is another object of the invention to provide an extendable pour cap with multiple external connecting means designed to simultaneously accommodate the use of multiple different closure caps.

It is another object of the invention to provide a multi-component closure assembly adapted for covering the threaded spout (or neck) of a container.

These and other objects of the present invention are achieved in the preferred embodiments disclosed below by providing an extendable pour cap. The pour cap includes a base adapted for attaching to a neck of a container. A flexible spout extends from the base and is adapted for communicating with an open mouth of the container. The flexible spout has integrally-formed bellows designed for converting the spout between a compressed condition and an extended condition. Means are provided for removably securing a first closure cap over the flexible spout when compressed. Further means are provided for removably securing a second closure cap over the flexible spout when compressed.

According to one preferred embodiment of the invention, the base has an internal thread adapted for mating with a complementary external thread formed with the neck of the container.

Preferably, the connecting means for securing the first closure cap comprises an external thread formed with the base and designed to mate with a complementary thread formed with the closure cap. Alternatively, the connecting means may comprise interfering structure formed with the base and closure cap sufficient to effect snap-attachment of the closure cap to the pour cap. This connecting means may also comprise complementary male and female elements.

Preferably, the connecting means for securing the second closure cap comprises an annular ridge located at a proximal end of the flexible spout, and cooperating with a complementary internal annular ridge formed with the second closure cap to snap attach the second closure cap to the pour cap. Alternatively, this connecting means may comprise other interfering structure formed with the base and closure cap sufficient to effect snap-attachment of the closure cap to the pour cap.

This connecting means may also comprise complementary threads or other male and female elements.

According to one preferred embodiment of the invention, a free end of the flexible spout defines a reduced-diameter tip.

Preferably, the tip is tapered.

According to one preferred embodiment of the invention, the base and flexible spout are integrally-formed together as a single unit.

In another embodiment, the invention is an extendable pour cap incorporating a base, flexible spout, and closure assembly. The base is adapted for attaching to a neck of a container. The flexible spout extends from the base and is adapted for communicating with an open mouth of the container. The flexible spout comprises integrally-formed bellows designed for converting the spout between a compressed condition and an extended condition. The closure assembly includes first and second closure caps. First connecting means are provided for removably securing the first closure cap over the flexible spout when compressed. Second connecting means are provided for removably securing the second closure cap over the first closure cap and the flexible spout when compressed. Preferably, the first and second connecting means comprises one or more of a structure, thread, and/or other male or female element designed to cooperate with a complementary structure, thread, and/or other male or female element to effect removable connection of the closure caps to the pour spout.

According to another preferred embodiment of the invention, the closure assembly further includes a third closure cap frictionally and removably secured over a tip of the flexible spout.

In yet another embodiment, the invention an extendable pour cap in combination with a container having a neck and an open mouth. The pour cap includes a base attached to the neck of the container. A flexible spout extends from the base and communicates with the open mouth of the container. The flexible spout comprises integrally-formed bellows designed for converting the spout between a compressed condition and an extended condition. First connecting means are provided for removably securing a first closure cap over the flexible spout when compressed. Second connecting means are provided for removably securing a second closure cap over the flexible spout when compressed. Preferably, the first and second connecting means comprises one or more of a structure, thread, and/or other male or female element designed to cooperate with a complementary structure, thread, and/or other male or female element to effect removable connection of the closure caps to the pour spout.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

The present invention is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be operative, enabling, and complete. Like numbers refer to like elements throughout. Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described.

Figure 1:
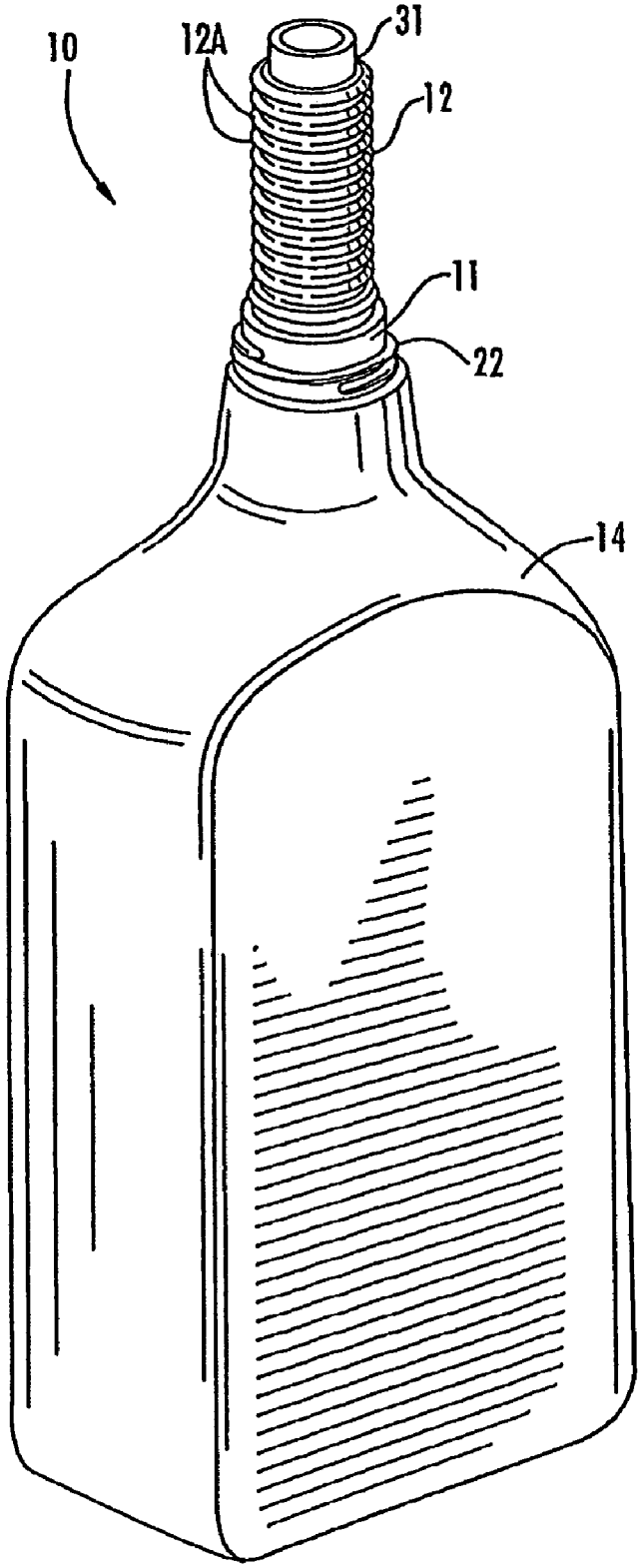
FIG. 1 is a perspective view of the extendable pour cap according to one preferred embodiment of the present invention, and showing the pour cap attached to a common plastic container with the flexible spout fully extended.
Figure 1A:
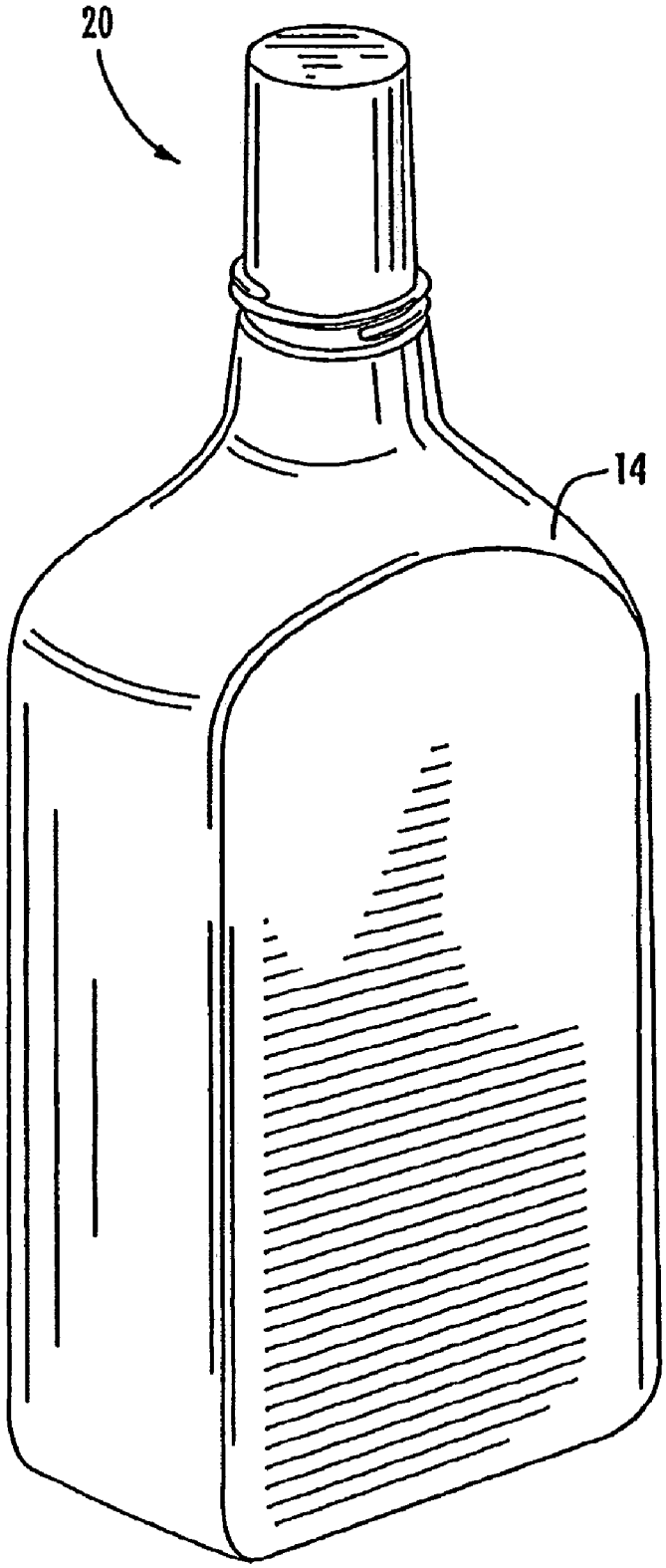
FIG. 1A is a further perspective view showing the closure assembly applied to the pour cap with the flexible spout in a compressed condition.
Figure 2:
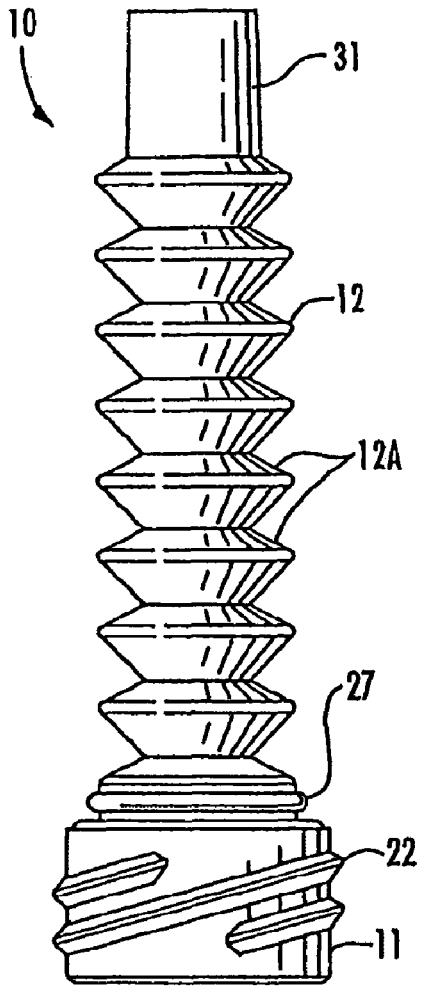
FIG. 2 is a side view of the pour cap in an extended condition.
Figure 3:
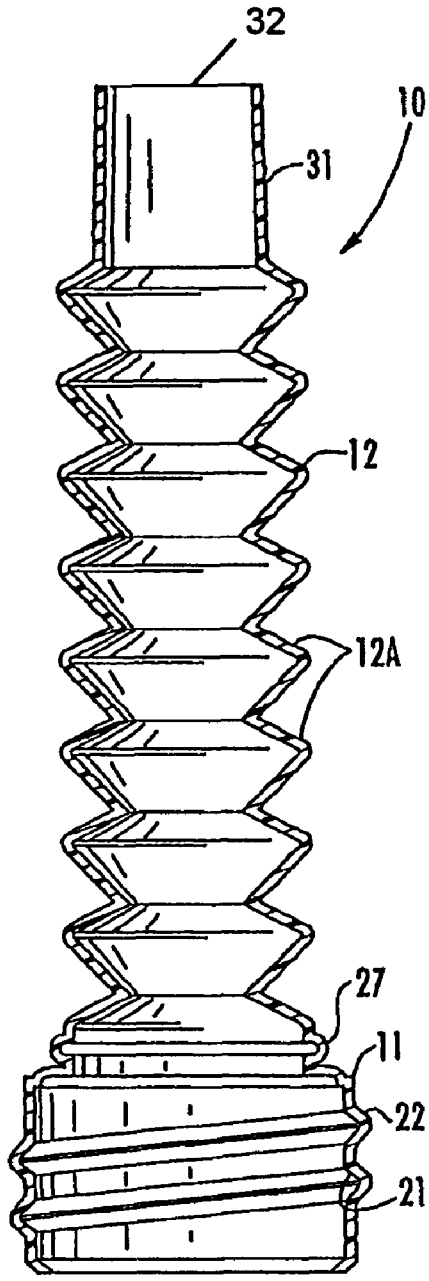
FIG. 3 is a cross-sectional view of the pour cap in the extended condition.
Figure 4:
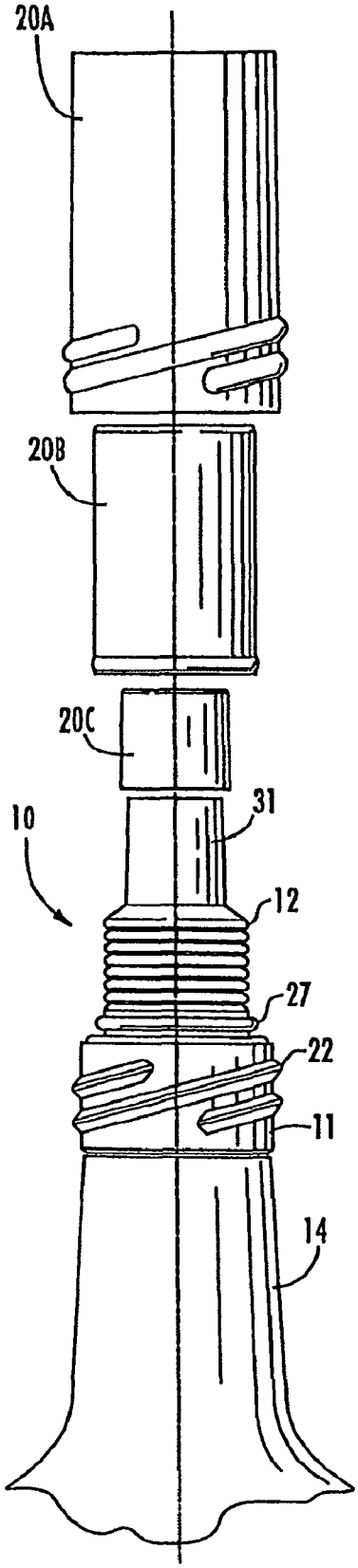
FIG. 4 is a fragmentary view of the container with the pour cap attached and showing components of the closure assembly exploded away.

Referring now specifically to the drawings, an extendable pour cap according to the present invention is illustrated in FIG. 1, and shown generally at reference numeral 10. The pour cap 10 comprises an enlarged-diameter base 11 and flexible spout 12. The base 11 and spout 12 are preferably integrally-formed together as a single molded unit designed for direct attachment to a container 14. The flexible spout 12 incorporates cooperating bellows 12A which enable extension of the spout 12 from the base 11 to facilitate convenient transfer of contents from the container 14 to an other container (not shown), such as a fuel tank, oil tank, radiator, or the like; or from the container 14 under any other circumstances where relatively controlled and focused dispensing is desired. When not in use, the flexible spout 12 may be compressed to a substantially reduced length—as much as 75-90% less than its total length when fully extended. Additionally, to preserve contents stored in the container 14, the pour cap 10 preferably includes a multi-component closure assembly 20 (shown generally in FIG. 1A) designed to cover and substantially seal the flexible spout 12.

Figure 5:
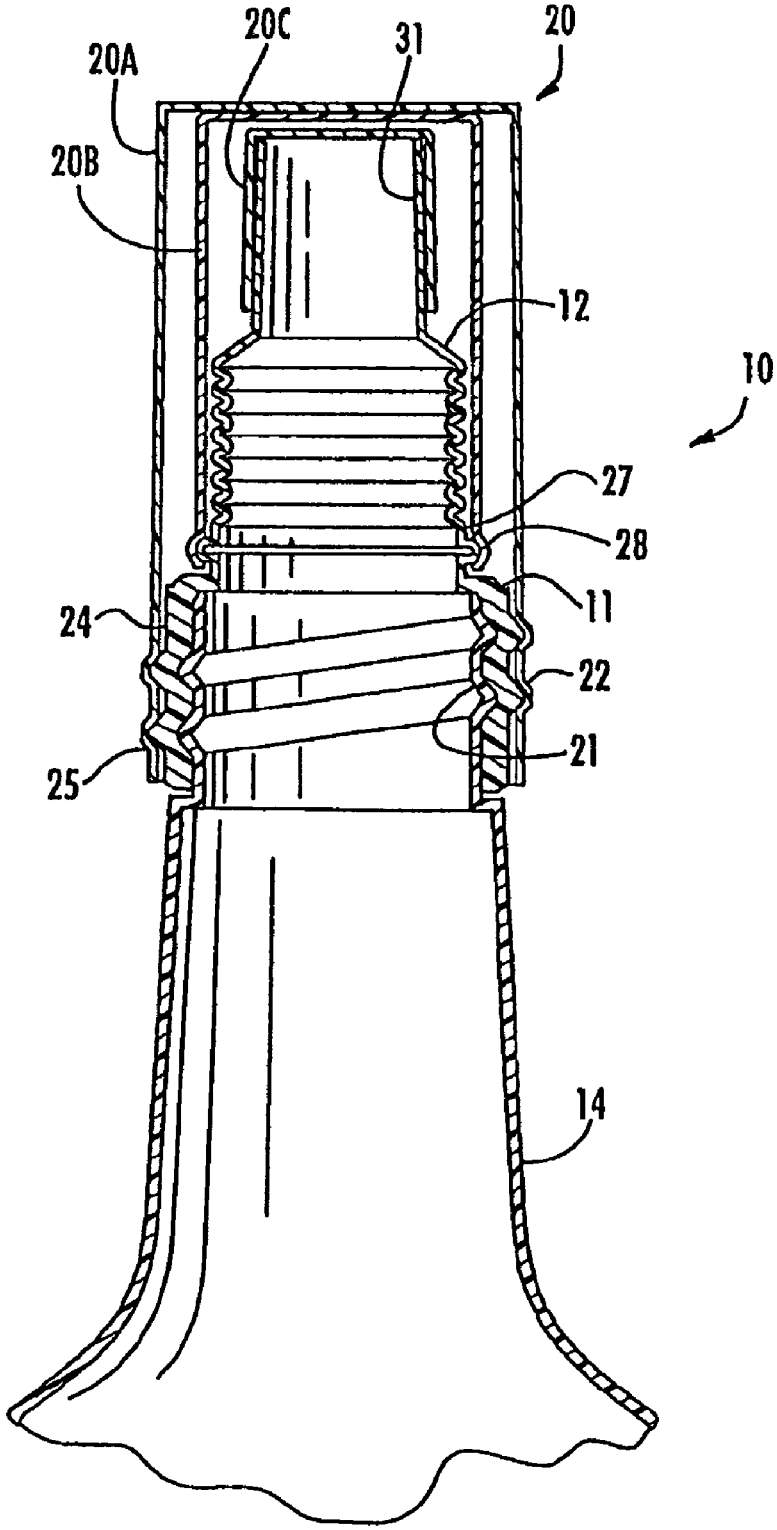
FIG. 5 is a cross-sectional view showing the pour cap and closure assembly attached to the container.

As best shown in FIGS. 2-5, the enlarged base 11 of the pour cap 10 defines corresponding internal and external screw threads 21 and 22. The internal thread 21 is designed to mate with a complementary thread 24 formed at the neck of the container 14 and adjacent its open mouth. The opposing external thread 22 of the base 11 forms a first external connecting means for securing a first closure cap 20A of the closure assembly 20 to the base 11, as illustrated in FIG. 5. The external base thread 22 mates with an complementary internal thread 25 of the closure cap 20A to removably secure the closure cap 20A over the flexible spout 12 and base 11.

The flexible spout 12 communicates with the open mouth of the container 14 and extends outwardly from the base 11 in fully extended, partially extended, and compressed conditions. Preferably, an annular ridge 27 is formed at the proximal end of the spout 12 and defines a second external connecting means for locating and securing a smaller, second closure cap 20B of the closure assembly 20. The second closure cap 20B has a complementary internal annular ridge 28 which cooperates with the external ridge 27 to snap-attach the closure cap 20B over the flexible spout 12 and beneath the outermost closure cap 20A.

According to one embodiment, the free end of the flexible spout 12 defines a reduced-diameter, elongated, tapered tip 31. The length of the tip 31 is preferably about 5-10% of the total length of the flexible spout 12 when fully extended. The tip 31 serves to further promote focused and controlled dispensing of contents from the container 14.

Figure 6:
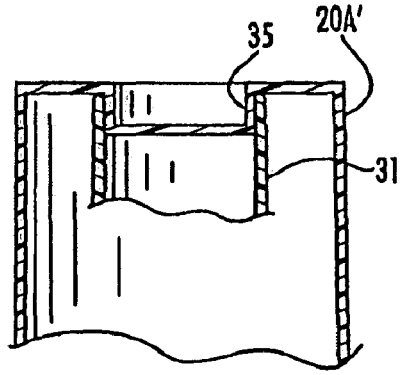
FIG. 6 is a fragmentary cross-section of the outermost closure cap according to an alternative embodiment of the invention.
Figure 7:
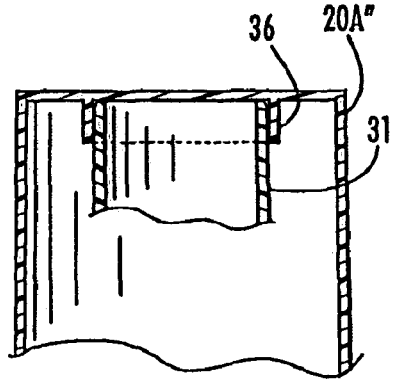
FIG. 7 is a fragmentary cross-section of the outermost closure cap according to yet another embodiment of the invention.

As an added means of preserving contents in the container 14, the closure assembly 20 may utilize a third and smallest closure cap 20C designed to fit over the spout opening 32 defined by the tapered tip 31. The closure cap 20C is frictionally secured to the tip 31, and resides beneath the outer caps 20A and 20B, as best shown in FIG. 5. As an alternative to the closure cap 20C, the outmost closure cap 20A' may incorporate a centrally-disposed internal plug 35, shown in FIG. 6, designed to fit inside the mouth of the tip 31 to further seal the spout 12. In yet another embodiment shown in FIG. 7, the closure cap 20A" may incorporate an internal centrally-disposed ring 36 designed to receive the tip 31 and further seal the open mouth of the spout 12.

The extendable pour cap 10 may incorporate any one or more of the closure caps 20A, 20B, 20C described above—used either alone or in any designed combination. For example, the pour cap 10 may incorporate only the outermost closure cap 20A, or may include only the closure cap 20B, or only the closure cap 20C, or a combination of closure caps 20A and 20C, or a combination of closure caps 20A and 20B, or a combination of closure caps 20B and 20C. Additionally, the present multi-component closure assembly 20 is applicable to any other non-extendable spouted container 14 with similar first and second external connecting means; and the present pour cap 10 may or may not utilize a closure cap including any one or more of the closure caps 20A-20C described herein.

An extendable pour cap is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. An extendable pour cap, comprising:

a base adapted for attaching to a neck of a container, and comprising a single wall defining corresponding internal and external threads on respective inside and outside surfaces of the wall;

a flexible spout extending from said base and adapted for communicating with an open mouth of the container, said flexible spout comprising integrally-formed bellows designed for converting said spout between a compressed condition and an extended condition;

and an annular ridge located at a proximal end of said flexible spout between said base and said integrally-formed bellows, and having a diameter greater than a diameter of said bellows and less than a diameter of said base, such that said annular ridge is designed to cooperate with a complementary internal ridge formed with a closure cap to removably snap attach the closure cap to said pour cap over said flexible spout in the compressed condition.

2. An extendable pour cap according to claim 1, wherein a free end of said flexible spout defines a reduced-diameter tip.

3. An extendable pour cap according to claim 2, wherein said tip is tapered.

4. An extendable pour cap according to claim 1, wherein said base and flexible spout are integrally-formed together as a single unit.

5. An extendable pour cap, comprising:

an enlarged-diameter base adapted for attaching to a neck of a container, and comprising a single wall defining corresponding internal and external threads on respective inside and outside surfaces of the wall;

a reduced-diameter flexible spout extending from said base and adapted for communicating with an open mouth of the container, said flexible spout comprising integrally-formed bellows designed for converting said spout between a compressed condition and an extended condition;

an annular ridge located at a proximal end of said flexible spout between said base and said integrally-formed bellows, and having a diameter greater than a diameter of said bellows and less than a diameter of said base; and a closure cap having an internal ridge designed to cooperate with said annular ridge to removably snap attach the closure cap to said pour cap over said flexible spout in the compressed condition.

6. An extendable pour cap according to claim 5, wherein a free end of said flexible spout defines a reduced-diameter tip.

7. An extendable pour cap according to claim 6, wherein said tip is tapered.

8. An extendable pour cap according to claim 5, wherein said base and flexible spout are integrally-formed together as a single unit.

9. In combination with a container comprising a neck and an open mouth, an extendable pour cap comprising:

a base adapted for attaching to a neck of a container, and comprising a single wall defining corresponding internal and external threads on respective inside and outside surfaces of the wall;

a flexible spout extending from said base and adapted for communicating with an open mouth of the container, said flexible spout comprising integrally-formed bellows designed for converting said spout between a compressed condition and an extended condition;

and an annular ridge located at a proximal end of said flexible spout between said base and said integrally-formed bellows, and having a diameter greater than a diameter of said bellows and less than a diameter of said base, such that said annular ridge is designed to cooperate with a complementary internal ridge formed with a closure cap to removably snap attach the closure cap to said pour cap over said flexible spout in the compressed condition.

10. A combination according to claim 9, wherein said base and flexible spout are integrally-formed together as a single unit.

* * * * *